United States Patent [19]

Obata et al.

[11] Patent Number: 4,533,273

[45] Date of Patent: Aug. 6, 1985

[54] APPLICATOR FOR AEROSOL-TYPE CONTAINERS

[75] Inventors: Saburo Obata, Suma; Kazuo Ito, Kamakura, both of Japan

[73] Assignees: Fujisawa Pharmaceutical Co., Ltd., Osaka; Toyo Seikan Kaisha, Ltd., Tokyo, both of Japan

[21] Appl. No.: 527,200

[22] Filed: Aug. 29, 1983

Related U.S. Application Data

[63] Continuation of Ser. No. 336,188, Dec. 31, 1981, abandoned.

[51] Int. Cl.[3] ..... A46B 11/02

[52] U.S. Cl. ..... 401/190; 401/286; 401/288

[58] Field of Search ..... 401/190; 222/402.13

[56] References Cited

U.S. PATENT DOCUMENTS

| | | | |
|---|---|---|---|
| Re. 26,367 | 4/1968 | Sagarin | 222/402.13 X |
| 3,184,781 | 5/1965 | Hoxie | 401/190 X |
| 3,685,913 | 8/1972 | Pass | 401/190 |
| 3,804,537 | 4/1974 | Pass | 401/190 |
| 3,958,726 | 5/1976 | Trotta | 222/402.13 |
| 3,981,597 | 9/1976 | Cohn | 401/190 |
| 4,053,090 | 10/1977 | Kelly et al. | 222/402.13 |
| 4,252,455 | 2/1981 | de la Pena | 401/190 |

FOREIGN PATENT DOCUMENTS

| | | | |
|---|---|---|---|
| 999593 | 7/1965 | United Kingdom | 401/190 |

*Primary Examiner*—Steven A. Bratlie

*Attorney, Agent, or Firm*—Oblon, Fisher, Spivak, McClelland & Maier

[57] ABSTRACT

An applicator for an aerosol-type container having a movable nozzle projecting from its head comprises a cap and a brush attached to the cap. The cap includes, as integrally molded together, a peripheral wall fittable to the head of the container to surround the nozzle, a nozzle pushing member, and a discharge tube fittable to the nozzle for supplying a foam of detergent from the container to the brush for cleaning when the pushing member is depressed. The applicator, which has the brush, can be used and stored as attached to the container.

2 Claims, 3 Drawing Figures

APPLICATOR FOR AEROSOL-TYPE CONTAINERS

This application is a continuation of application Ser. No. 336,188, filed Dec. 31, 1981, now abandoned.

The present invention relates to an applicator for aerosol-type containers which have a movable nozzle projecting from the head of the container for discharging the contents by gas pressure when the nozzle is pushed, and more particularly to an applicator useful as a cleaning device and comprising a brush and a cap fittable to such a container.

Articles are cleaned with a foamable detergent contained in such an aerosol-type container usually by pushing the movable nozzle of the container to spray a foam of detergent onto the article and brushing the article. Conventionally, however, the container and the brush are separate from each other and are therefore inconvenient to use, store and maintain.

The main object of this invention is to overcome the inconvenience heretofore experienced and to provide an applicator which is useful for aerosol-type containers having a nozzle and which comprises a brush and a cap including, as integrally molded together, a peripheral wall having the brush attached thereto and fittable to the head of the container body to surround the nozzle, a nozzle pushing member, and a discharge tube fittable to the nozzle for supplying the contents of the container to the brush.

Accordingly the applicator, which has the brush, can be used, stored and maintained as attached to the container and is convenient to use, compact in construction, minimized in the number of parts, easy to assemble, inexpensive to make and usable free of leakage.

An embodiment of the invention will be described below with reference to the accompanying drawings, in which.

Figure 1:
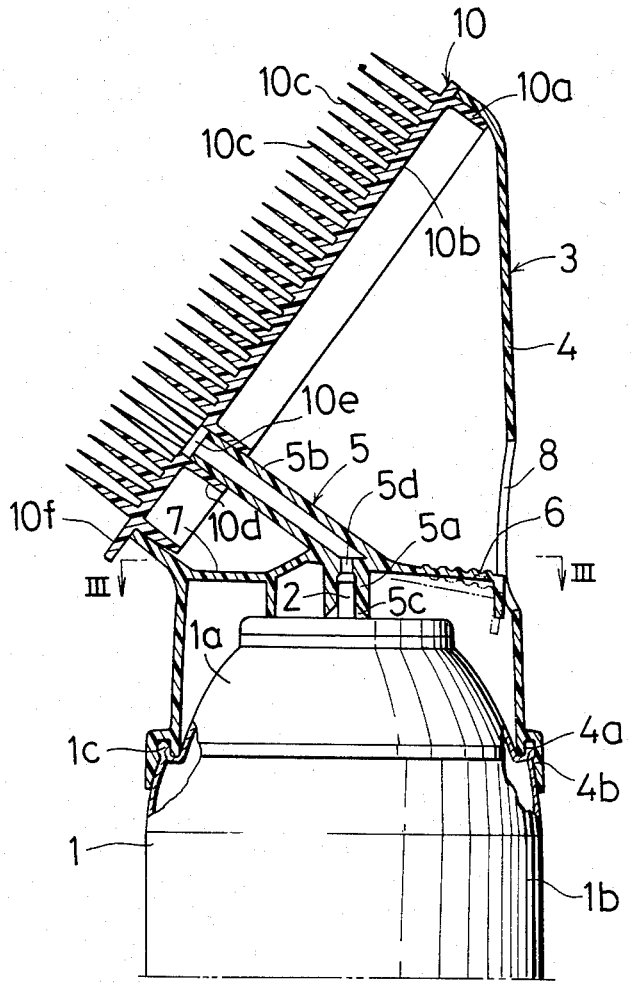
FIG. 1 is a side elevation in section showing an applicator embodying the invention and attached to a container.
Figure 2:
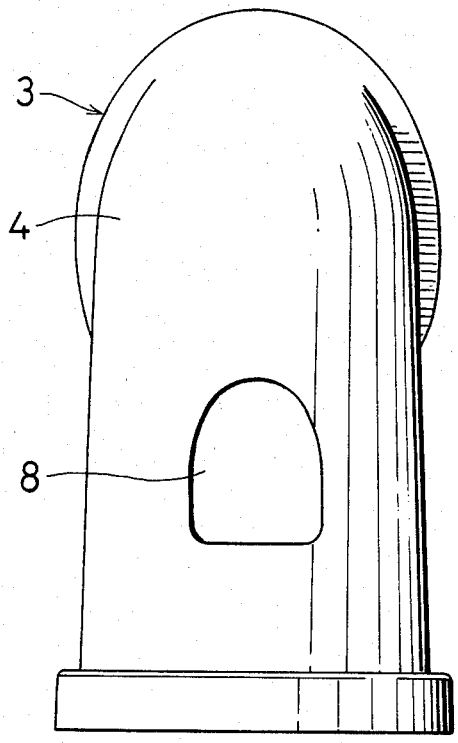
FIG. 2 is a rear view showing the applicator.
Figure 3:
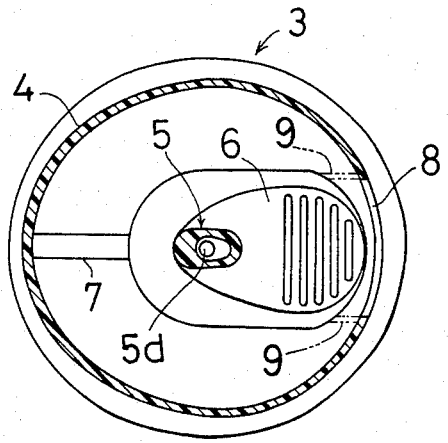
FIG. 3 is a view in section taken along the line III—III in FIG. 1.

With reference to the drawings, indicated at 1 is the main body of an aerosol-type container. The main body 1 has a movable nozzle 2 projecting upward from its head 1*a*. When the nozzle 2 is depressed in its vertical position or in an inclined position, a valve incorporated in the container main body 1 is opened, whereby a foamable detergent filled in the main body 1 is caused to jet out from an opening at the forward end of the nozzle 2 by the pressure of gas enclosed in the main body 1. A cap 3 is molded in the form of an integral piece from polypropylene or like synthetic resin having some flexibility. The cap 3 has a peripheral wall 4 which is formed with a groove 4*a* at its lower end. The groove 4*a* is fitted to a crimped portion 1*c* where the head 1*a* is joined to the trunk 1*b* of the main body 1. An undercut portion 4*b* formed on the inner periphery of the outer side wall defining the groove 4*a* is in engagement with the crimped portion 1*c*. The cap peripheral wall 4 has an open forward end which is inclined with respect to the axis of the container main body 1. A discharge tube 5 disposed inside the peripheral wall 4 has one end 5*a* which is fitted to the movable nozzle 2 surrounded by the wall 4. The other end 5*b* of the discharge tube 5 extends obliquely and projects outward slightly beyond the forward end of the peripheral wall 4. The open end 5*a* of the discharge tube 5 has a tapered inner peripheral surface 5*c* so as to be easily fittable to the movable nozzle 2. The tube 5 has an intermediate portion having a constriction 5*d* and externally formed with a nozzle pushing member 6 integral therewith. An outer peripheral portion of the pushing member 6 is connected to the inner surface of the peripheral wall 4 by a flexible connecting portion 7 having a small width. The pushing member 6 is opposed to a finger aperture 8 formed in the wall 4 and positioned on one side of the member 6 opposite to the connecting portion 7.

A brush 10 integrally molded from polyethylene or like flexible synthetic resin has a tubular portion 10*a* fitting in the open forward end of the cap peripheral wall 4. The tubular portion 10*a* is formed at its outer end with a bottom 10*b* having a multiplicity of bristles 10*c* extending outward therefrom. The bottom 10*b* has an outlet 10*e* provided with a tubular wall 10*d* projecting inward from the bottom 10*b*. The projecting end of the discharge tube 5 is fitted in the tubular wall 10*d*. The brush 10 has a knob 10*f* which is used for removing the brush 10 from the cap peripheral wall 4. In the illustrated embodiment, the bottom 10*b* extends at an angle of about 37° with respect to an axis of the nozzle.

The applicator is used in the following manner. When the pushing member 6 is depressed with a finger inserted into the cap peripheral wall 4 through the aperture 8, with the container main body 1 gripped by the hand, the pushing member 6 is inclined as indicated in broken lines in FIG. 1 by elastically deforming the connecting portion 7 and at least one of the other end portion 5*b* of the discharge tube 5 and the tubular wall 10*d* at the outlet 10*e*. The member 6 inclines or depresses the movable nozzle 2, causing the foamable detergent in the main body 1 to jet out from the nozzle 2 on foaming and reach the outlet 10*e* of the brush 10 through the discharge tube 5. The detergent is supplied to the bristles 10*c* of the brush 10 from the outlet 10*e*. Accordingly dirt can be removed from the article to be cleaned by brushing the article with the brush 10 in this state. When the pushing member 6 is freed from the pressure, the nozzle 2 is returned to the initial vertical or projected position by an unillustrated spring in the main body 1 to stop the discharge of the detergent. The elastically deformed portions, such as the connecting portion 7, restore themselves, and the pushing member 6 returns to the initial position. The detergent can be supplied to the brush 10 intermittently by repeatedly depressing and releasing the pushing member 6 to move the member 6 up and down.

The embodiment described above is easy to use because the brush is inclined and because the finger aperture 8 is formed in a back portion of the wall 4 opposite the brush.

According to the invention, the contents of the container are not limited to the detergent but suitable liquids or compositions are usable for application. The brush is replaceable by an applicator element comprising an open-cellular elastic foam.

As described above, the applicator of this invention is useful for aerosol-type containers which are generally used and which have a movable nozzle 2 projecting from the head 1*a* of the container main body 1 for discharging the contents by gas pressure when the nozzle 2 is pushed. When fitted to the head 1*a* of the container body 1, the cap peripheral wall 4 surrounds the nozzle 2, and one end of the discharge tube 5 disposed inside the wall 4 is fitted to the nozzle 2. The nozzle pushing member 6 is integral with the discharge tube 5 and is opposed to the finger aperture 8 formed in the peripheral wall 4. The brush 10 fitted to the forward end of the wall 4 is connected to the other end of the discharge tube 5, with its bristled side in communication therewith. When the nozzle 2 is pushed by the member 6 which is depressed with a finger through the aperture 8, the contents can be supplied from the nozzle 2 to the brush 10 via the discharge tube 5. Thus the contents can be discharged from the container and applied to the desired article by a single hand. The applicator is therefore easy and convenient to use and assures a facilitated and efficient spraying operation. Moreover, the applicator can be stored compactly with its cap attached to the container. Especially because the applicator comprises the cap 3 including the wall 4, tube 5 and pushing member 6 which are integrally molded together, and the brush 10 attached to the wall 4, it is made up of only two parts, easy to assemble and inexpensive to make. Since the nozzle 2 is held in communication with the brush 10 by the discharge tube 5 alone, the contents can be supplied smoothly with reduced resistance, without leakage, with a less likelihood of excessive use and with a reduction in the amount of contents eventually remaining in the container, while permitting smooth return of the pushing member 6.

What is claimed is:

1. An applicator for an aerosol-type container having a container body and a movable nozzle projecting from the head of the container for discharging the contents thereof by gas pressure when the nozzle is pushed, the applicator comprising a cleaning brush and a cap including a peripheral wall fittable to the head of the container body to surround the movable nozzle, a discharge tube disposed inside the cap peripheral wall and having one end fittable to the nozzle and extending in a direction having a radial component with respect to an axis of said nozzle, and a nozzle pushing member integral with the discharge tube, said discharge tube and pushing member being movably connected at a portion thereof by connector means to the cap peripheral wall, said connector means consisting only of a straight, flat, flexible strip, the nozzle pushing member being enclosed by said cap and being in facing relation to a finger aperture formed in the cap peripheral wall, the cap peripheral wall, the discharge tube and the nozzle pushing member being unitarily molded from substantially rigid synthetic resin, the cleaning brush being fitted to the forward end of the cap peripheral wall and slidably connected to the other end of the discharge tube with a bristle side of said cleaning brush in communication with said other end of said discharge tube, said cleaning brush having bristles formed of polyethylene resin, wherein said connector means extends in a substantially radial direction with respect to said axis of said nozzle and is positioned substantially circumferentially opposite side finger aperture and substantially in alignment with said radial component of said discharge tube, with respect to said nozzle axis, and wherein said cleaning brush includes a bottom from which said bristles extend, said brush being fitted to said cap such that said bottom extends at an acute positive angle with respect to said axis of said nozzle.

2. The applicator of claim 1 wherein said angle is approximately 37°.

* * * * *